US006746103B2

(12) United States Patent
Tanuma

(10) Patent No.: US 6,746,103 B2
(45) Date of Patent: Jun. 8, 2004

(54) RECORDING HEAD AND RECORDING APPARATUS USING THE SAME

(75) Inventor: Chiaki Tanuma, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/245,604

(22) Filed: Sep. 17, 2002

(65) Prior Publication Data

US 2003/0058290 A1 Mar. 27, 2003

(30) Foreign Application Priority Data

Sep. 17, 2001 (JP) ..... 2001-281137

(51) Int. Cl.[7] ..... B41J 2/15
(52) U.S. Cl. ..... 347/40; 347/12
(58) Field of Search ..... 347/42, 13, 41, 347/43, 40, 12

(56) References Cited

U.S. PATENT DOCUMENTS 4,091,390 A 5/1978 Smith et al.
5,268,767 A 12/1993 Kurtin et al.
6,000,784 A * 12/1999 Takemoto ..... 347/50

* cited by examiner

*Primary Examiner*—Lamson Nguyen
(74) *Attorney, Agent, or Firm*—Frishauf, Holtz, Goodman & Chick, P.C.

(57) ABSTRACT

A single recording head is provided which includes a set of plural head units each having a substrate and plural recording elements arranged on the substrate, whereby a line type recording head which is long in a main scanning direction can be manufactured easily and in high yield. The head units are arranged to be inclined so that the rows of recording elements are inclined in the main scanning direction, whereby the arrangement pitch of recording elements in a sub scanning direction is narrowed to permit a high definition recording. The inclined arrangement of the head units, moreover, is made so that the recording elements located at the same position on the substrates of separate head units lie on the same main scanning line, whereby an increase of size in the sub scanning direction is prevented and a reduction of the entire size is attained.

11 Claims, 8 Drawing Sheets

RECORDING HEAD AND RECORDING APPARATUS USING THE SAME

BACKGROUND OF THE INVENTION

1. Field of the Invention

The present invention relates to a line type recording head, and a recording apparatus which performs a recording operation for recording paper with use of the line type recording head.

2. Discussion of the Background

Heretofore, an ink jet printer head, a thermal printer head, and an LED head have been practically used as line type recording heads.

A line type recording head has plural recording elements arranged in a line and is attached to a recording apparatus in such a manner that the recording elements are arranged in a main scanning direction. The recording elements are driven selectively while recording paper is moved relatively in a sub scanning direction, to record a desired image on the recording paper.

In such a line type recording head, a maximum print width of the recording apparatus is determined by the arrangement length of the recording elements. Therefore, the line type recording head is generally popular as a recording head for recording paper of a narrow width, but is seldom used as a recording head for such a widely spread size of recording paper as A4 size. This is for the following reason. As the maximum print width increases, the arrangement length of recording elements must be made longer, but the longer the arrangement of recording elements, the more difficult the production of the recording head becomes or the lower the yield becomes.

In an effort to avoid such an inconvenience, there has been proposed such a method as is disclosed, for example, in Japanese Unexamined Patent Publication No. Hei 11-20176 in which plural head units are joined together to constitute a single recording head.

On the other hand, it is an important subject for the recording head to attain a high density of recording elements for achieving a high definition of recording. In this connection, as to a line type recording head, in the aforesaid publication Hei 11-20176 there are disclosed a method for attaining a high density of recording elements in which a recording head wider than the maximum recording width is disposed to be inclined with respect to a main scanning line or a method for attaining a high density of recording elements in which a recording head constituted by joining plural head units is disposed to be inclined with respect to a main scanning line.

The invention disclosed in the foregoing publication Hei 11-20176 is concerned with a method for uniforming the spacing of recording elements at the time of disposing a recording head to be inclined with respect to a main scanning line, the recording head being constituted by joining plural head units.

Such a conventional technique involves problems which will be described below. Reference has been made above to the method of attaining a high density of recording elements by disposing a recording head to be inclined with respect to a main scanning line, the recording head being constituted by joining plural head units. FIG. 1 is a schematic diagram showing an example of a recording head which adopts the high density realizing method. As shown in the same figure, a recording head 101 is constituted by joining plural head units 103 each having plural recording elements 102 arranged in a line, the recording head 101 being inclined with respect to a main scanning line 104.

However, the recording head 101 constructed as in FIG. 1 involves the problem that its size in a sub scanning direction, or paper feed direction, increases. The larger the number of head units 103 to be joined, the more conspicuous the increase in size in the sub scanning direction becomes, thus leading to an increase in size of the recording head 101 as a whole.

SUMMARY OF THE INVENTION

It is an object of the present invention to attain the reduction in size of a line type recording head which can effect a high definition recording by a combination of plural head units.

The object of the present invention is achieved by the novel recording head and recording apparatus using the recording head of the present invention.

According to the present invention there is provided a line type recording head comprising: a plurality of head units each having a substrate and a plurality of recording elements arranged on a virtual line on the substrate; and a head holder for positioning and holding at least one array units so that the recording elements in all of the head units are arranged at equal pitches in a main scanning direction, the array units being each constituted by a set of plural head units arranged to be inclined with respect to a main scanning line in such a manner that the recording elements arranged at the same position on the substrates of separate head units lie on the same main scanning line. According to this construction, since the recording head is constituted by a set of plural head units, the production of the recording head is easy and the yield thereof is high. Moreover, since each head unit is inclined with respect to a main scanning line, it is possible to effect a high definition recording. Further, since plural head units are arranged to be inclined with respect to a main scanning line so that the recording elements located at the same position on the substrates of separate head units are positioned on the same main scanning line, the size of the recording head does not become large in a sub scanning direction irrespective of the number of head units used.

According to the present invention there is further provided a recording apparatus comprising: a line type recording head; a scanning mechanism for moving the recording head and recording paper relatively in a sub scanning direction; and a drive control circuit for controlling the operation of the recording head. The line type recording head comprising: a plurality of head units each having a substrate and a plurality of recording elements arranged on a virtual line on the substrate; and a head holder for positioning and holding at least one array units so that the recording elements in all of the head units are arranged at equal pitches in a main scanning direction, the array units being each constituted by a set of plural head units arranged to be inclined with respect to a main scanning line in such a manner that the recording elements arranged at the same position on the substrates of separate head units lie on the same main scanning line. The drive control circuit includes a print timing controller which makes a delay control so that the recording elements in the head units not positioned on the same main scanning line operate on the same main scanning line. According to this construction, since the recording head is constituted by a set of plural head units, it is easy to produce the recording head and the production yield thereof is high.

Moreover, since the head units are arranged to be inclined with respect to the main scanning line, it is possible to effect a high definition recording. Further, since the plural head units are arranged to be inclined with respect to the main scanning line in such a manner that the recording elements located at the same position on the substrates of separate head units lie on the same main scanning line, the size of the recording head does not increase in the sub scanning line irrespective of the number of head units used.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Preferred embodiments of the present invention will be described hereinunder with reference to FIGS. 2 to 8.

Figure 1:
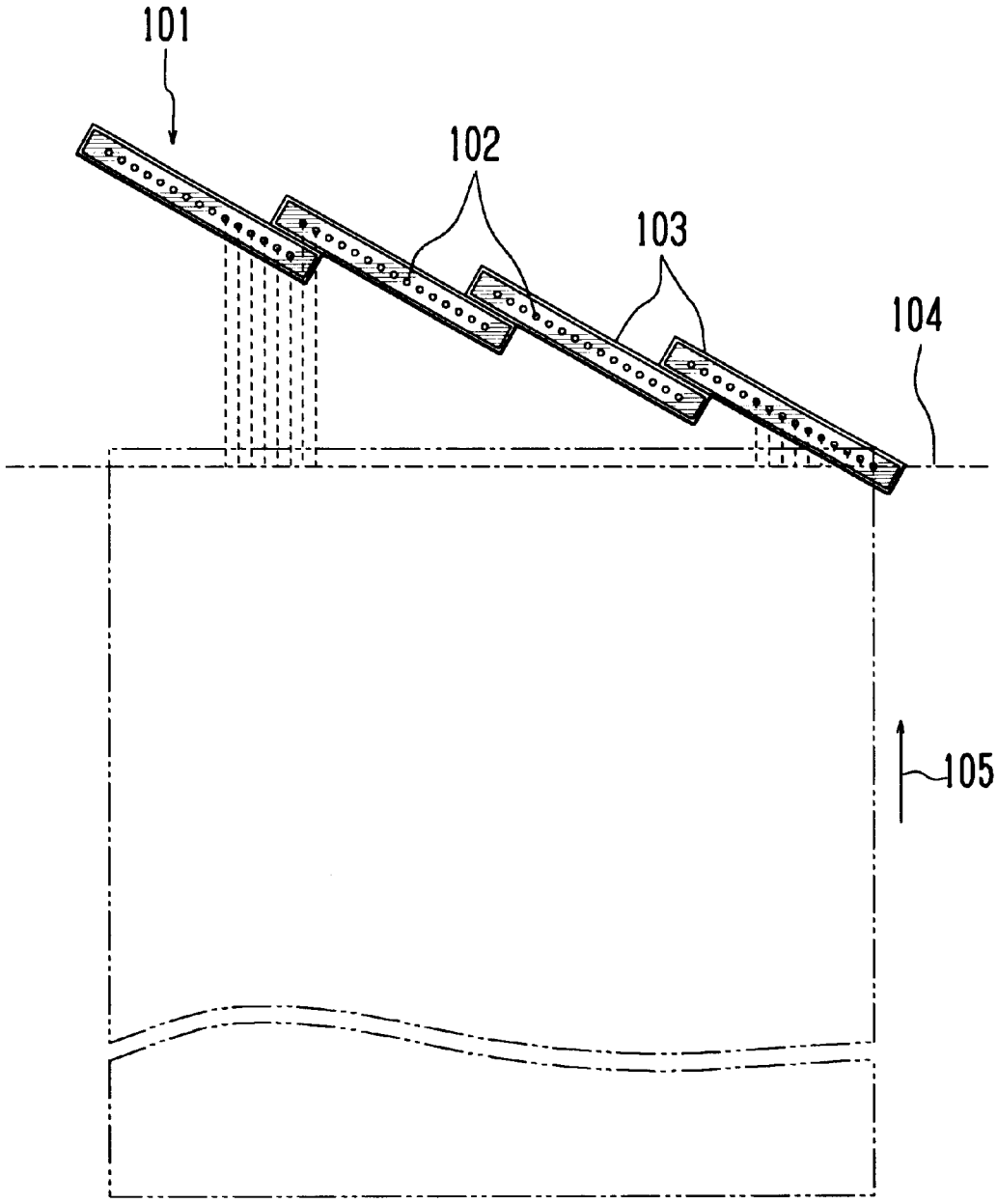
FIG. 1 is a schematic diagram showing, as a conventional example, a line type recording head which can perform a high definition recording by a combination of plural head units.
Figure 2:
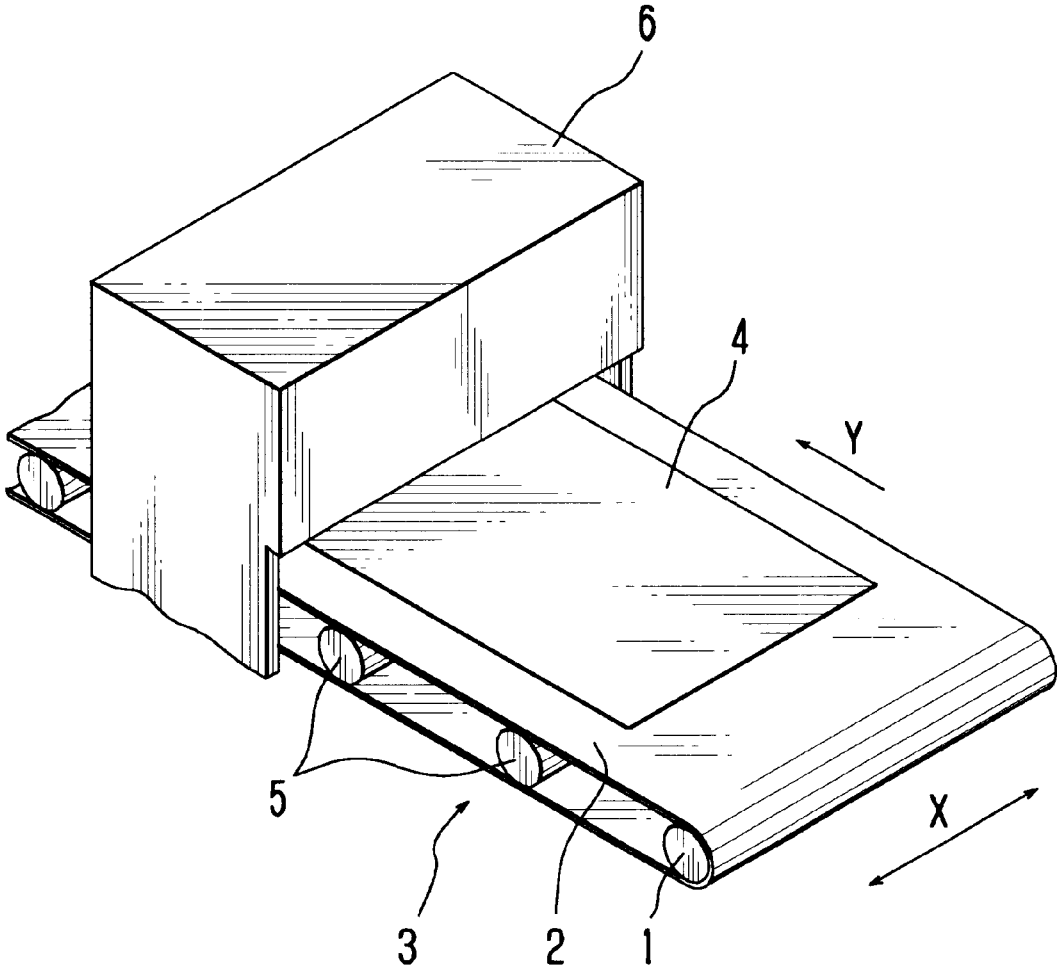
FIG. 2 is a perspective view of a recording apparatus according to a first embodiment of the present invention.

FIG. 2 is a perspective view of a recording apparatus. In the recording apparatus there is provided a scanning mechanism 3 constituted by an endless belt 2 which is entrained on a pair of rollers 1 (one is not shown). The scanning mechanism 3 conveys recording paper 4 by rotation of the belt 2. The rotation of the belt 2 is effected by rotation of one roller 1 which is rotated by a drive source (not shown). In FIG. 2 there are also shown other rollers than roller 1, which rollers are intermediate rollers 5 for retaining the shape of the belt 2.

As shown in FIG. 2, a recording head 6 is provided at an intermediate position of the scanning mechanism 3. The recording head 6 performs a recording operation for the recording paper 4 which is conveyed by the scanning mechanism 3. The recording head 6 is a line type ink jet printer head in which recording elements 7 to be described later are arranged in a main scanning direction X (indicated with arrow in FIG. 2). In combination with movement of the recording paper 4 in a sub scanning direction Y (indicated with arrow in FIG. 2) by the scanning mechanism 3, the recording head 6 records a desired image on the recording paper.

Although an ink jet printing method is referred to in this embodiment as a recording method of the recording head 6, this is a mere example and there may be adopted another recording method. That is, in this embodiment, the recording method is not specially limited insofar as the recording head 6 is a line type recording head, and there may be used recording heads 6 which adopt various recording methods. For example, there may be used a line type thermal printer head or LED head.

Figure 3:
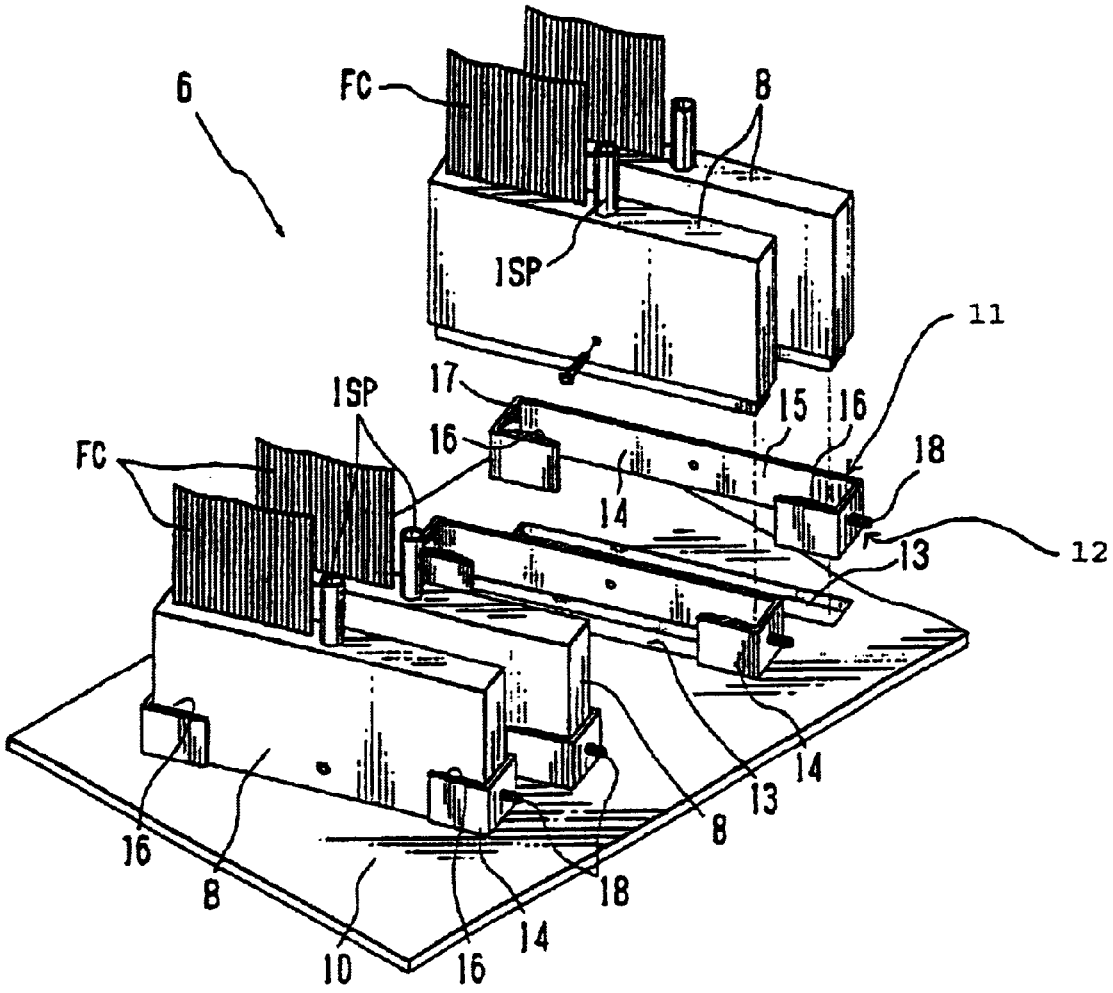
FIG. 3 is an exploded perspective view of a recording head.

In this embodiment, as illustrated in FIG. 3, the recording head 6 is constituted by a set of plural head units 8 which are arranged in the main scanning direction. Therefore, in each of the head units 8 which constitute the recording head 6, it is preferable that a substrate 9 (see FIG. 4) with recording elements 7 arranged thereon be disposed perpendicularly in opposition to the recording paper 4 which is conveyed by the scanning mechanism 3. In this sense it is preferable for the substrate 9 to be disposed perpendicularly to the belt 2 which carries the recording paper 4 thereon. Therefore, in case of using a thermal printer head as each of the head units 8 which constitute the recording head 6, it is preferable to use a vertical type end-face head having heating elements as recording elements 7 formed on an end face thereof. However, the thermal printer head as each head unit 8 is limited to such a vertical type end-face unit. For example, there also may be used an edge head to be disposed to be inclined with respect to the substrate, the edge head having heating elements as recording elements 7 formed on an edge portion thereof.

The substrate 9 means a portion where the recording elements 7 are arranged in opposition to the recording paper 4 which is conveyed by the scanning mechanism 3. Therefore, in the case where an ink jet printer head is used as each head unit 8 as in this embodiment, the substrate 9 means an orifice plate having ink ejecting orifices as recording elements 7. The substrate 9 is not used in the sense of plate, but merely means an end face of each head unit 8 with recording elements 7 arranged thereon. In this sense, in the case where a printer head other than the ink jet printer head is used as the head unit 8, it is allowable that a front end face of the printer head is not constitution of plate.

FIG. 3 is an exploded perspective view of the recording head 6. In the recording head 6 constituted by plural head units 8, the plural head units 8 are installed on a base 10 which is like a flat plate. It is head holder 11 that mounts the head units 8 to the base 10. The head holder 11 has a position adjusting mechanism 12 which makes the head units 8 adjustable positionally.

As noted above, the recording head 6 is constituted by a combination of plural head units 8. Each head unit 8 is an ink jet printer head. Each head unit 8, in its appearance, is provided with an ink supply pipe ISP for receiving ink supplied and a flexible cable FC for supplying electric power to a drive unit (not shown) which causes ink to fly.

Head holes 13, which cause the substrates 9 of the head units 8 to confront the recording paper 4 carried on the belt 2, are formed in the base 10 in a corresponding relation to the head units 8. The head holes 13 are formed to be inclined with respect to the main scanning direction X (see FIG. 2) and are arrange without deviating in the sub scanning direction (see FIG. 2). Such an array of the head holes 13 determines the array of the head units 8, but this point will be described later with reference to FIG. 4.

The head holder 11 is located in the position of each head hole 13 formed in the base 10. More specifically, head holding frames 14 of a shape which surrounds the outer periphery surface of each head unit 8 are fixed respectively to the positions of the head holes 13. The head holding frames 14 are each provided with a bonding surface 15 for bonding thereto of one surface of each head unit 8, and a pair of plate springs 16, which constitute a support mechanism for pressing the head unit 8, are provided on the bonding surface 15. With the plate springs 16, the head unit 8 is pushed against the bonding surface 15 in the interior of the associated head holding frame 14. The head holding frame 14 and the head unit 8 are set at a size which permits the head unit 8 to move in the arranged direction of the recording elements 7 within the head holding frame 14. In this connection, the head holding frame 14 contains a plate spring 17 as an elastic member which constitutes a support mechanism so that it can elastically receive the motion of the head unit 8 moving in the arranged direction of the recording elements 7 within the head holding frame 1.

An adjusting screw 18 is threadedly engaged with a side of each head holding frame 14 opposite to the side where the plate spring 17 is provided. The adjusting screw 18 constitutes a positioning mechanism whose tip portion moves rotationally toward and away from the plate spring 17. The tip of the adjusting screw 18 is in abutment against one side of the head unit 8 held by the head holding frame 14. Since the tip position of the adjusting screw 18 is thus changed by rotation of the adjusting screw, it becomes possible to move the head unit 8 which is supported elastically by the plate spring 17. As a result, the head unit 8 is displaced in the arranged direction of the recording elements 7 while increasing or decreasing the elastic force of the plate spring 17.

Figure 4:
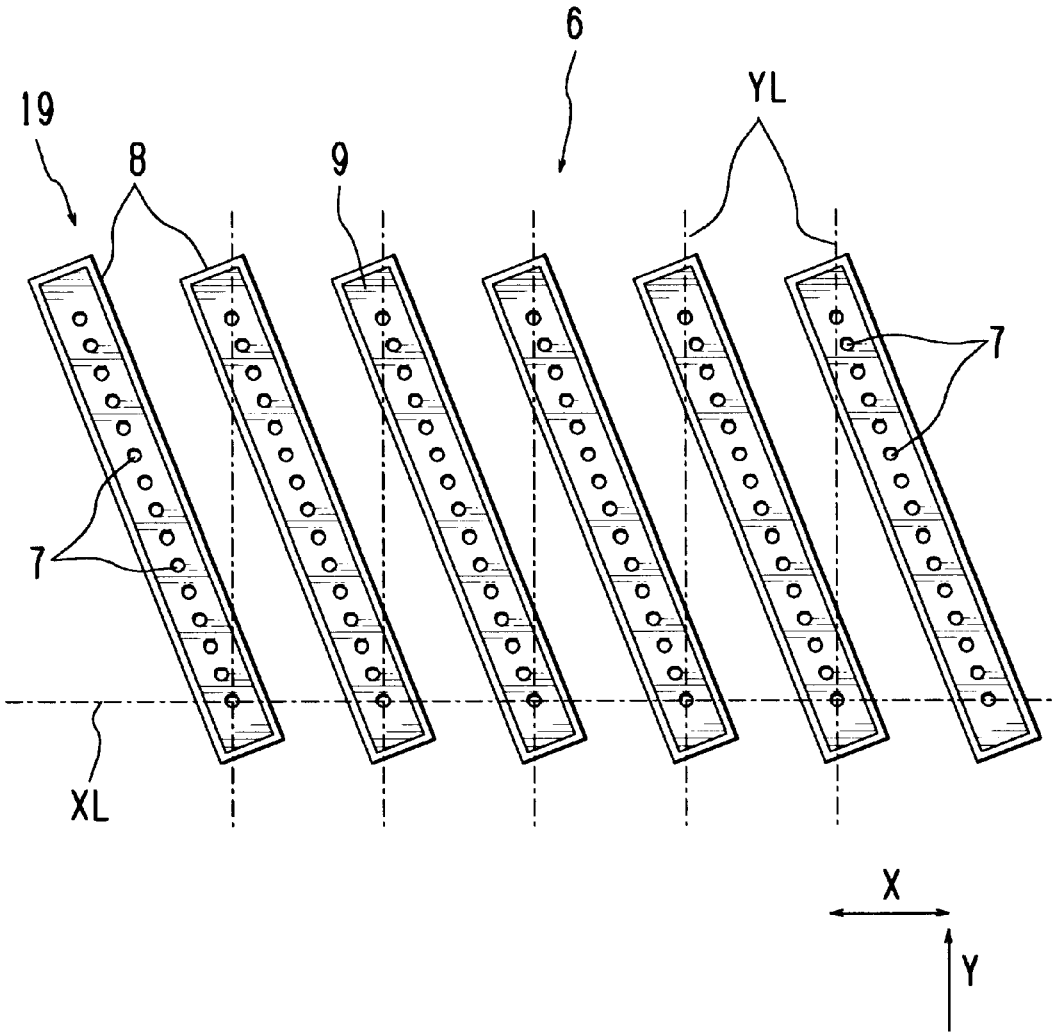
FIG. 4 is a front view showing an example of an array unit which is a set of head units.

FIG. 4 is a front view illustrating an array unit which is a set of head units 8. The head units 8 are arranged to be inclined with respect to the main scanning direction X (see FIGS. 2 and 4) depending on the arrangement of the head holes 13 and head holding frames 14. To be more specific, the head units 8 are arranged to be inclined with respect to a main scanning line XL so that the recording elements 7 located at the same portion on the substrates 9 of different head units 8 line on the same main scanning line XL. In this embodiment, a set of plural head units 8 thus arranged to be inclined is conceived as a single array unit 19. Only one such array unit 19 is provided. The head units 8 are positioned so that the recording elements 7 in all the head units 8 are arranged at equal pitches in the main scanning direction. As is apparent from FIG. 4, there is adopted an arrangement such that, in mutually adjacent head units 8, the recording elements 7 located at endmost positions continuous in the main scanning direction X overlap each other on sub scanning lines YL.

Figure 5:
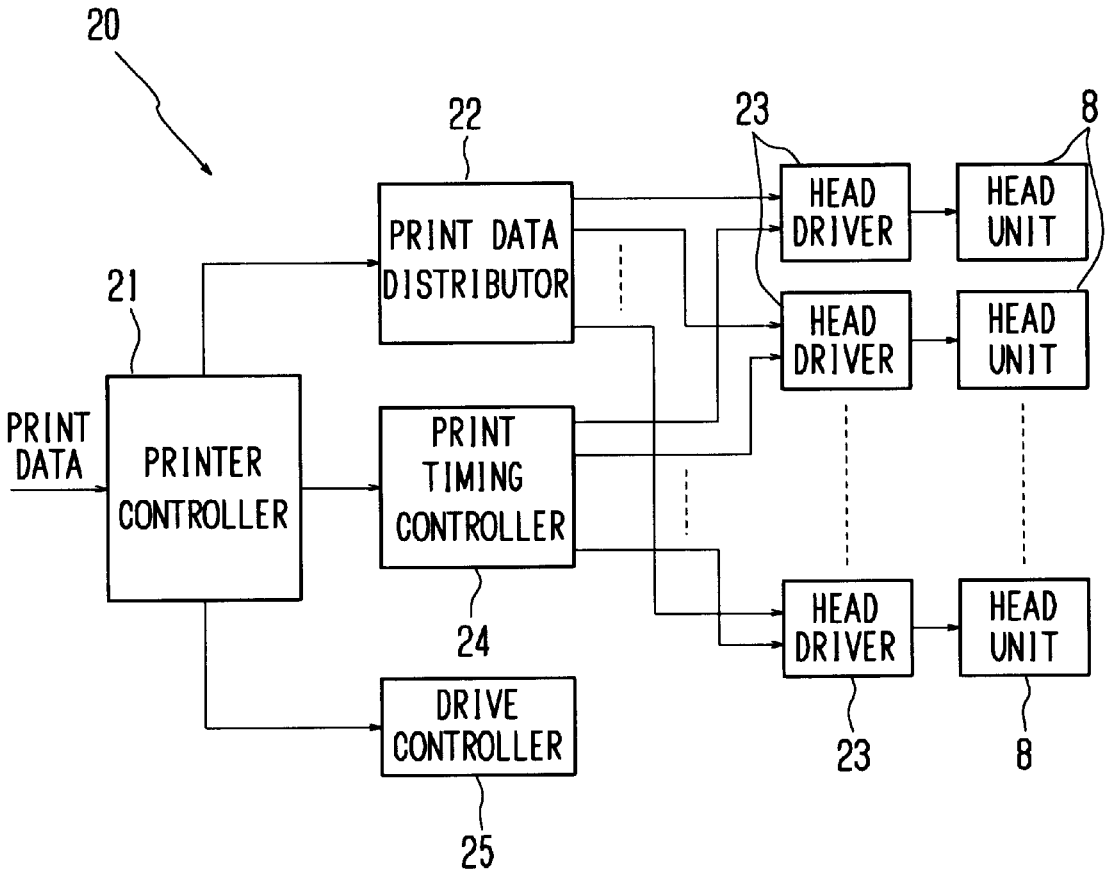
FIG. 5 is a block diagram showing a drive control circuit.

FIG. 5 is a block diagram showing a drive control circuit. The recording apparatus of this embodiment is provided with a drive control circuit 20 separately from the recording head 6. The drive control circuit shown in FIG. 5 includes components themselves which constitute a digital circuit and also includes functions implemented by a computer. The computer-implemented functions are executed by control of various portions which control is performed by a microprocessor such as CPU in accordance with program codes stored in storage mediums such as ROM and RAM.

In the drive control circuit 20, print data fed from a host computer (not shown) is transmitted to a print data distributor 22. It is optional whether a printer controller 21 is to be built by constituents of a digital circuit or built as a function of a computer. The print data distributor 22 distributes the received print data to head drivers 23 in the head units 8. It is also optional whether the print data distributor 22 is to be built by constituents of a digital circuit or built as a function of a computer.

The head driver 23 is a digital circuit constituted as hardware by shift register, latch, and driver (none of them are shown). Print data is fed to the head driver 23 one line by one line from the print data distributor 22. The print data fed to the head driver 23 is registered in the shift register and is latched, then a strobe pulse is applied to the latch, whereby the operation of the recording elements 7 is started by the driver.

In the recording head 6 of this embodiment, as shown in FIG. 4, the recording elements 7 which should contribute to recording on the same main scanning line XL (see FIG. 4) for the recording paper 4 are deviated in the sub scanning direction Y. Therefore, if the recording elements 7 to be operated in the corresponding head unit 8 are operated at the same timing on the basis of the print data distributed to the head driver 23 from the print data distributor 22, dots which should be recorded on the same main scanning line XL on the recording paper by the recording elements 7 are deviated in the sub scanning direction Y. In this embodiment, to avoid such an inconvenience, there is provided a print timing controller 24 which is built as a function of a computer for example, to control an input timing of a strobe pulse for the head driver 23. As a result, on the basis of the print data distributed from the print data distributor 22 to the head driver 23, the timing of each recording element 7 to be operated in the corresponding head unit 8 is delayed by a required time, whereby it is possible to prevent dots from being deviated in the sub scanning direction Y which dots should be recorded on the main scanning line XL by the recording elements 7 and thus a correct recording operation is executed.

Further, the drive control circuit 20 is provided with a drive controller 25 which undergoes a synthetic control of the printer controller 21. With the drive controller 25, the operation of the rollers 1 for rotating the belt 2 is controlled and hence the feed of the recording paper 4 is controlled.

Figure 6:
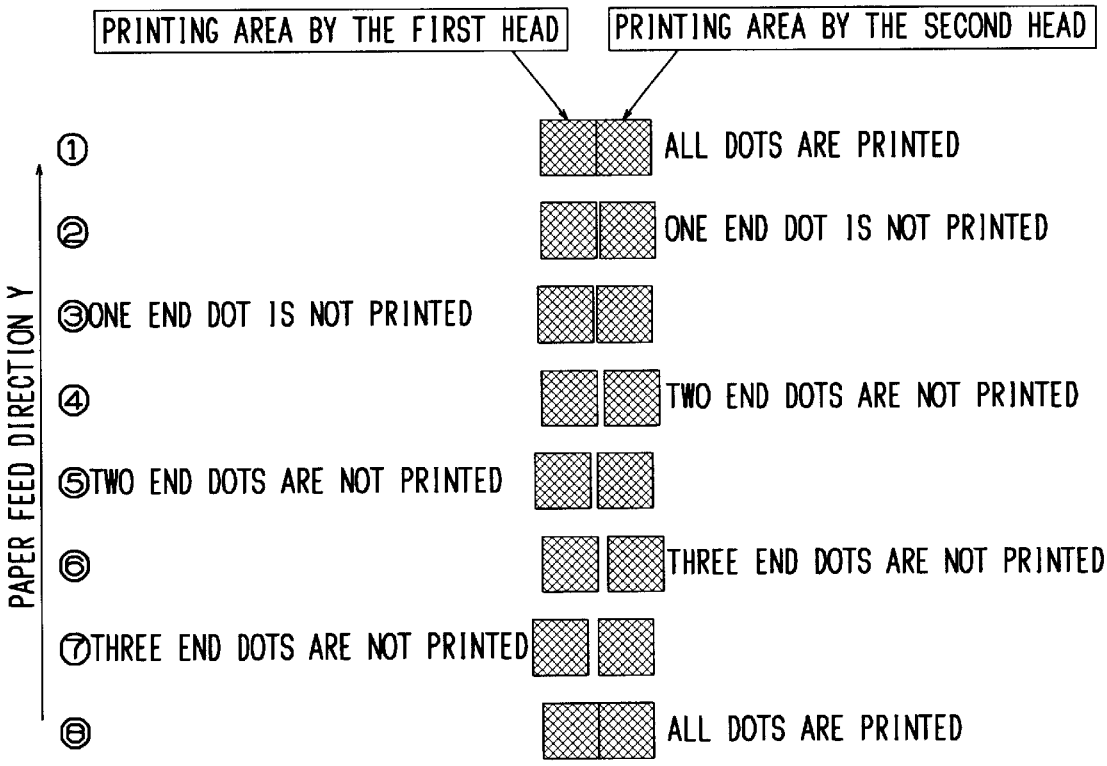
FIG. 6 is a schematic diagram for explaining a mechanical position adjusting work for each head unit.
Figure 7:
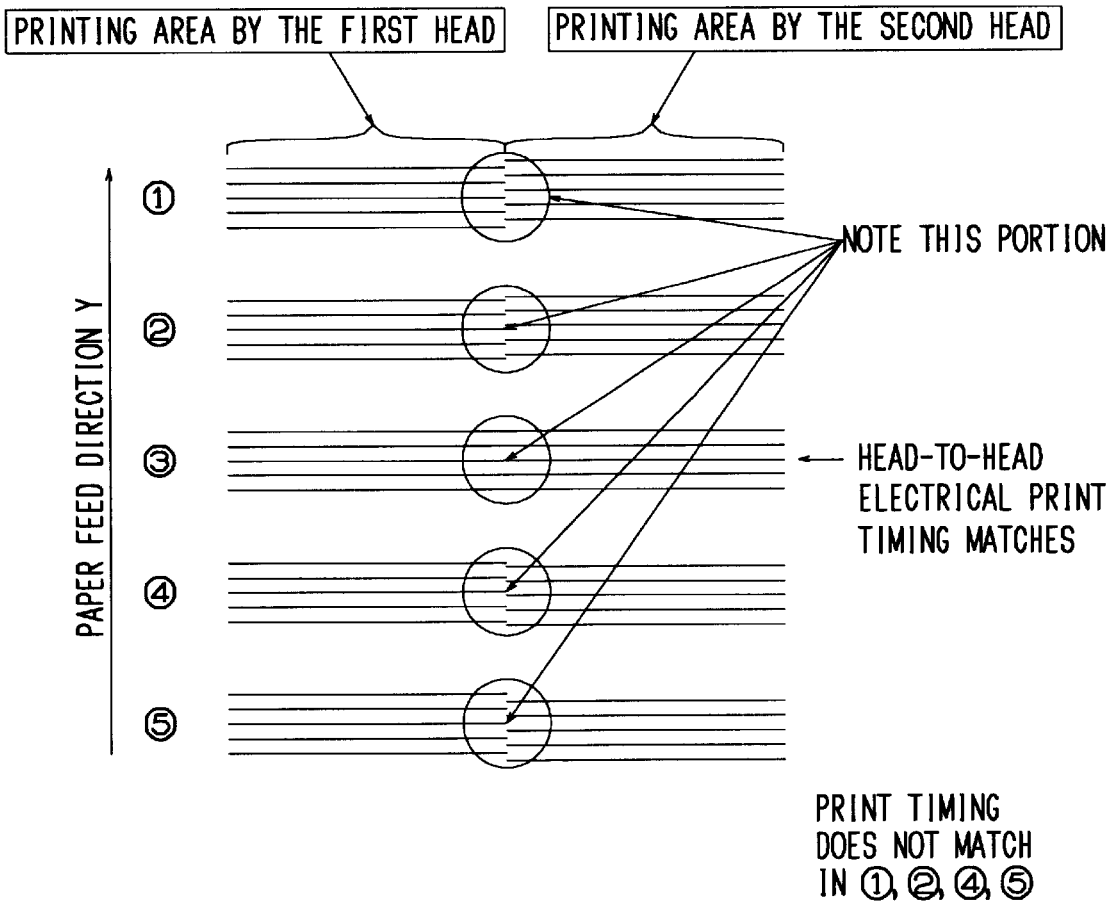
FIG. 7 is a schematic diagram for explaining a record timing control.

FIG. 6 is a schematic diagram for explaining a mechanical position adjusting work for each head unit 8 and FIG. 7 is a schematic diagram for explaining a record timing control.

Since in this embodiment a single recording head 6 is constituted by arranging plural head units 8 side by side on the base 10, it is necessary to make a fine adjustment for each head unit 8. In this embodiment there are provided two kinds of fine adjustments. According to one adjustment, each head unit 8 is displaced mechanically in the main scanning direction X to make uniform the arrangement pitch in the sub scanning direction Y of adjacent recording elements 7 in adjacent head units 8. The other adjustment is adjusting the delay timing of a strobe pulse in the print timing controller 24.

First, with reference to FIG. 6, a description will be given about the mechanical position adjusting work for each head unit 8. In the mechanical position adjusting work for each head unit 8, firstly, all the recording elements 7 are operated to print all dots (①). Then, printing is made in a state such that the recording element 7 located at an end position of one head unit 8 adjacent to another head unit 8 is not operated by one dot (②), likewise printing is made in a state such that the recording element 7 located at an end position of the other head unit 8 adjacent to one head unit 8 is not operated by one dot (③), this is repeated until printing is made in a state such that the end recording element 7 is not operated by three dots (④ to ⑥), and again all the recording elements 7 are operated to print all dots (⑦). In this way there is obtained a print result on the recording paper 4. Then, while observing the print result, each head unit 8 is subjected to a mechanical position adjustment. This adjustment is made by rotating the adjusting screw 18 to displace the head unit 8 in the arranged direction of the recording elements 7.

The adjustment based on the print result on the recording paper 4 is performed by making sure that there is neither white line or dot overlap in the patterns ① and ⑦ in FIG. 6. That is, the displacement adjustment for each head unit 8 by rotation of the adjusting screw 18 is performed until there is neither white line nor dot overlap in the patterns ① and ⑦ in FIG. 6. In this case, the adjusting work is carried out in a sequence such that, for example in relation to a head unit 8 located at an extremity position, a head unit 8 adjacent thereto is adjusted, then in relation to the thus-adjusted head unit 8, a head unit 8 adjacent thereto is adjusted. In this way it becomes possible to display each head unit 8 mechanically in the main scanning direction X and make uniform the arrangement pitch in the sub scanning direction Y of adjacent recording elements 7 in adjacent head units 8.

In this embodiment, as shown in FIG. 4, two recording elements 7 adjacent in the main scanning direction in adjacent head units 8 positionally overlap with each other on the sub scanning line YL. Therefore, although as an adjusting method based on the print result on the recording paper 4 reference has been made to the method wherein the adjustment is made by making sure that there is neither white line nor dot overlap in the patterns ① and ⑦ in FIG. 6, if there is a positional overlap on the sub scanning line YL of recording elements 7 as in FIG. 4, it follows that a complete overlap of dots corresponds to a positional match. Therefore, as in this embodiment, when two recording elements 7 adjacent in the main scanning direction in adjacent head unit 8 positionally overlap on the sub scanning line YL, the freedom of any positional deviation is confirmed by a complete overlap of dots in the patterns ① and ⑦ in FIG. 6. In this case, in actual printing there occurs an overlap of dots between adjacent head units 8, so the recording element 7 participating in the overlap in one head unit 8 is not operated.

Next, with reference to FIG. 7, a description will be given about adjusting the delay timing of a strobe pulse in the print timing controller 24. For this adjustment, there are printed such plural lateral lines as are illustrated in FIG. 7. At this time, as shown in ①, ②, ④, and ⑤ in the same figure, if there occurs a lateral line deviation between two adjacent head units 8, it follows that the delay timing does not match between the head units, so for one head unit 8 the delay timing of a strobe pulse in the print timing controller 24 is deviated, whereby it is possible to effect adjustment of the strobe pulse delay timing in the print timing controller 24. In this case, the adjusting work is performed in a sequence such that, for example in relation to the head unit 8 positioned at an extremity, the head unit 8 adjacent thereto is adjusted, then in relation to the thus-adjusted head unit the head unit 8 adjacent thereto is adjusted. In this way adjustment of the strobe pulse delay timing in the print timing controller 24 for each head unit 8 is completed and it becomes possible to eliminate a deviation on the main scanning line XL of adjacent recording elements 7 in adjacent head units 8.

In the recording head 6 of this embodiment constructed as above, there is formed a long line of recording elements 7 in the main scanning direction X by gathering plural head units 8. Thus, since the recording head 6 is constituted by a set of plural head units 8, the production of the head unit 6 is easy and the yield thereof is high.

Moreover, since the head units 8 are arranged to be inclined with respect to the main scanning line, the arrangement pitch of the recording elements 7 in the sub scanning direction Y is narrow and it is possible to effect a high definition recording.

Further, the plural head units 8 are arranged to be inclined with respect to the main scanning line in such a manner that the recording elements 7 located at the same position on the substrates 9 of different head units 8 lie on the same main scanning line. According to this arrangement, the size of the recording head 6 does not increase in the sub scanning direction Y irrespective of the number of head units 8.

Figure 8:
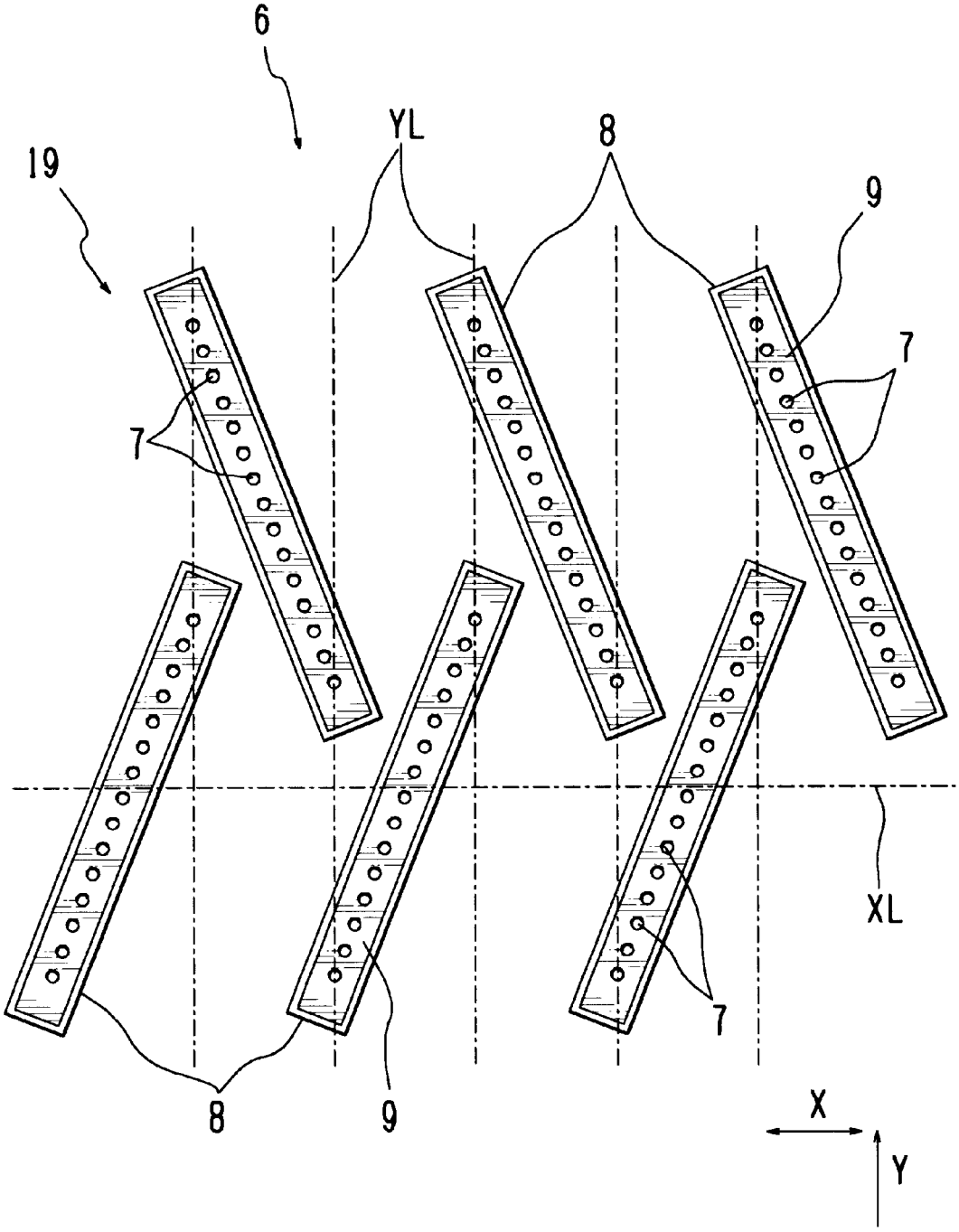
FIG. 8 is a front view showing an array unit which is a set of head units according to a second embodiment of the present invention.

FIG. 8 is a front view illustrating an array unit 19 of a recording head 6 according to another embodiment of the present invention, the array unit 19 being a set of head units 8. In the embodiment illustrated in FIG. 8, there are provided two array units 19 each capable of being conceived as a set of plural head units 8. Head units 8 which constitute one array unit 19 and those constituting the other array unit 19 are different in the direction of inclination relative to the main scanning line XL. The two array units 19 are combined and arranged so that adjacent head units 8 are inclined in alternate directions. Consequently, the head units 8 are arranged zigzag as in FIG. 8.

In such a construction, the distance of arrangement between adjacent recording elements 7 in adjacent head units 8 becomes narrower than in the arrangement illustrated in FIG. 4. As a result, it is possible to easily smooth the linkage of recorded images by the recording elements 7 provided in such separate head units 8.

Although in each of the above two embodiments the recording head 6 is constituted by one or two array units 19, it may be constituted by three or more array units in practicing the invention.

According to the recording apparatuses of the above embodiments, the recording head 6 can be produced easily in high yield and it is possible to effect a high definition printing. Besides, it is possible to prevent an increase in size of the recording head 6 in the sub scanning direction irrespective of the number of head units 8 used and hence possible to attain the reduction in size of the entire recording head 6. In the case where the recording head 6 is constituted by only a single array unit 19, it is possible to attain a further reduction of size in the sub scanning direction. Where the recording head 6 is constituted by two array units 19, it is possible to realize a recording head which is long in the main scanning direction. Where two array units 19 different in the direction of inclination relative to the main scanning line are held by the head holder 11 so that adjacent head units 8 are inclined in alternate directions, the distance of arrangement between adjacent recording elements 7 in adjacent head units 8 can be narrowed, whereby it is possible to easily smooth the linkage of recorded images by the recording elements 7 provided in such separate head units 8. The head holder 11 holds the head units in a state such that two recording elements 2 adjacent in the main scanning direction in adjacent head units 8 positionally overlap on the sub scanning line, so when the positional adjustment between adjacent recording elements 7 in adjacent head units 8 is performed while checking the result of having performed a recording operation for the recording paper 4, it is possible to facilitate the adjusting work. Where the head holder 11 is provided with the position adjusting mechanism 12 which makes the associated head unit 8 movable so that the recording elements 7 move in the main scanning direction, the position adjustment between adjacent recording elements 7 in adjacent head units 8 can be done easily by the position adjusting mechanism 12. For example, the position adjusting mechanism 12 can be constructed by such simple mechanisms as a support mechanism 16 which supports the associated head unit 8 movably in the arranged direction of recording elements 7 and a positioning mechanism 18 which positions the movable head unit 8 at a desired position. For the support mechanism 16 there may be used, for example, an elastic member 17 which positions the head unit 8 elastically in the arranged direction of recording elements 7. For the positioning mechanism 18 there may be used, for example, an adjusting screw 18 whose tip is abutted against the head unit 8 and is rotated to move the head unit so as to increase or decrease the elastic force of the elastic member 17. The use of the elastic member 17 and the adjusting screw 18 permits a more simplified mechanical construction. For example, in case of using ink jet printer heads as head units 8, the head units can be easily arranged as required originally by the present invention, that is, the invention can be practiced so much easily. The ink jet printer heads are of a structure which requires pressure chambers to be formed side by side and therefore it is difficult to narrow the spacing between recording elements 7 to a greater extent than a certain value, thus obstructing the attainment of a high density. But the application of the present invention permits the execution of an extremely high density recording with use of ink jet printer heads as head units 8.

Obviously, numerous modifications and variations of the present invention are possible in light of the above teachings. It is therefore to be understood that within the scope of the appended claims, the invention may be practiced otherwise than as specifically described herein.

The present application is based on Japanese Priority Documents P2001-281137 filed on Sep. 17, 2001, the content of which is incorporated herein by reference.

What is claimed is:

1. A recording head, comprising:

a plurality of head units each having a substrate and a plurality of recording elements arranged on a virtual line on the substrate;

at least one array unit comprising a set of the plurality of head units arranged to be inclined with respect to a main scanning line in such a manner that the recording elements arranged at a same position on the substrates of the head units lie on the same main scanning line; and a plurality of head holders for positioning and holding the head units of the at least one array unit so as to arrange the recording elements in all of the head units at equal pitches in a main scanning direction;

wherein operation of the plurality of recording elements in the main scanning direction is controlled to perform a recording operation on recording paper which is moved relatively in a sub scanning direction.

2. A recording head according to claim 1, wherein the recording head is constituted by only one array unit.

3. A recording head according to claim 1, wherein the recording head is constituted by two array units.

4. A recording head according to claim 3, wherein the plurality of head holders hold two array units having a different direction of inclination with respect to the main scanning line in such a manner that adjacent ones of the head units are inclined in alternate directions.

5. A recording head according to claim 1, wherein the plurality of head holders hold the head units in a state such that two recording elements located at endmost positions in adjacent ones of the head units overlap each other on a sub scanning line.

6. A recording head according to claim 1, wherein the head holders each comprise a position adjusting mechanism which makes the head units positionally adjustable.

7. A recording head according to claim 6, wherein the position adjusting mechanisms each comprise: a support mechanism which movably supports the head units in a direction of the recording elements; and a positioning mechanism for positioning the movable head units at desired positions.

8. A recording head according to claim 7, wherein the support mechanisms each comprise an elastic member for positioning the head units elastically in the direction of the recording elements, and wherein the positioning mechanisms each comprise an adjusting screw whose tip is abutted against a respective one of the head units and which is rotatable to move the respective one of the head units so as to increase or decrease an elastic force of the elastic member.

9. A recording head according to claim 1, wherein the head units are ink jet printer heads.

10. A recording apparatus comprising:

(i) a recording head comprising:

a plurality of head units each having a substrate and a plurality of recording elements arranged on a virtual line on the substrate;

at least one array unit comprising a set of the plurality of head units arranged to be inclined with respect to a main scanning line in such a manner that the recording elements arranged at a same position on the substrates of the head units lie on the same main scanning line; and a plurality of head holders for positioning and holding the head units of the at least one array unit so as to arrange the recording elements in all of the head units at equal pitches in a main scanning direction;

(ii) a scanning mechanism for moving the recording head and a recording paper relatively in a sub scanning direction; and (iii) a drive control circuit which controls operation of the recording head, and which includes a print timing controller that performs delay control so that the recording elements in respective ones of the head units not positioned on the main scanning line operate on the same main scanning line.

11. A recording apparatus according to claim 10, wherein the head units are ink jet printer heads.

* * * * *